US007530566B2

(12) United States Patent
Terao et al.

(10) Patent No.: US 7,530,566 B2
(45) Date of Patent: May 12, 2009

(54) SHEET POST-PROCESSING APPARATUS

(75) Inventors: Yasunobu Terao, Izunokuni (JP); Tomomi Iijima, Mishima (JP); Mikio Yamamoto, Izunokuni (JP); Takahiro Kawaguchi, Mishima (JP); Hiroyuki Taki, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 4 days.

(21) Appl. No.: 11/695,274

(22) Filed: Apr. 2, 2007

(65) Prior Publication Data

US 2008/0237973 A1 Oct. 2, 2008

(51) Int. Cl.
*B65H 31/00* (2006.01)

(52) U.S. Cl. ..... 271/207; 271/218; 271/189; 271/3.02; 270/58.07

(58) Field of Classification Search ..... 271/207, 271/218, 189, 3.02; 270/58.07
See application file for complete search history.

(56) References Cited

U.S. PATENT DOCUMENTS 4,379,549 A * 4/1983 Mizuma ..... 271/3.02
4,456,238 A * 6/1984 Mizuma ..... 271/3.02
5,338,022 A * 8/1994 Funk et al. ..... 271/184
6,561,504 B2 * 5/2003 Mlejnek et al. ..... 270/58.12
6,951,334 B2 * 10/2005 Saito ..... 271/207
6,986,510 B2 * 1/2006 Saito et al. ..... 271/220
7,192,029 B2 * 3/2007 Fukatsu et al. ..... 271/306
7,213,808 B2 * 5/2007 Botschek et al. ..... 271/225
7,306,213 B2 * 12/2007 Terao et al. ..... 270/58.08
7,306,215 B2 * 12/2007 Terao et al. ..... 270/58.11

FOREIGN PATENT DOCUMENTS

JP 06-144671 5/1994

* cited by examiner

*Primary Examiner*—Kaitlin S Joerger
(74) *Attorney, Agent, or Firm*—Amin, Turocy & Calvin, LLP

(57) ABSTRACT

A sheet post-processing apparatus includes driving rollers that are arranged in a leading end position in a sheet conveying direction of a standby tray and axis of which are perpendicular to the conveying direction and driven rollers that rotate following the driving rollers and are provided in a front portion in the sheet conveying direction of the standby tray such that an interval thereof narrows in the sheet conveying direction. The driven rollers may be arranged in the front in the sheet conveying direction of the standby tray while being spaced apart from the standby tray.

10 Claims, 10 Drawing Sheets

SHEET POST-PROCESSING APPARATUS

BACKGROUND OF THE INVENTION

1. Field of the Invention

The present invention relates to a sheet post-processing apparatus that performs post-processing for sheets discharged from image forming apparatuses such as a copying machine, a printer, and a multifunction peripheral.

2. Description of the Related Art

Among image forming apparatuses (hereinafter referred to as MFPs), there is an MFP in which a sheet post-processing apparatus is provided adjacent to a paper discharging unit of an MFP main body in order to perform sheet post-processing for subjecting sheets after image formation to sort processing, staple processing, or the like.

In the sheet post-processing apparatus, a standby tray that subjects a sheet to buffering in the middle of a conveying path of the sheet post-processing apparatus is provided in order to adjust sheet discharge timing from the MFP and sheet post-processing timing to each other. In performing post-processing, there is a step of dropping sheets from the standby tray to a processing tray that aligns the sheets with respect to a processing device such as a stapler and performs positioning. In this step, since a movable sheet receiving plate of the standby tray opens in a direction perpendicular to a conveying direction, there is a problem in that, when there is no member that supports the center of the sheets and, in particular, the sheets are sheets of a large size such as A3 or LD, the sheets may curve in a V shape and may not fall to the processing tray in a desired shape.

In relation to this problem, an image forming apparatus is proposed in which, for the purpose of stretching a curled sheet at the time of printing, a driving roller having a rotating shaft perpendicular to a conveying direction of sheets is provided and a driven roller that forms a pair with this driving roller and rotates following the driving roller is arranged to obliquely cross the rotating shaft of the driving roller (e.g., JP-A-6-144671).

However, the apparatus in the application described above is not devised on the premise that sheets are dropped from a standby tray to a processing tray. Thus, it is impossible to solve the problem simply by providing this apparatus.

SUMMARY OF THE INVENTION

It is an object of the present invention to provide a sheet post-processing apparatus including a driven roller for dropping sheets from a standby tray to a processing tray in a desired shape.

In an aspect of the present invention, a sheet post-processing apparatus includes:

a standby tray that subjects a sheet discharged from an image forming apparatus to buffering while the sheet is sent to a conveying path at the next stage;

a processing tray that is arranged below the standby tray and on which the sheet dropped and supplied from the standby tray and/or the sheet discharged from the image forming apparatus without passing through the standby tray is stacked;

driving rollers that are arranged in a leading end position in a sheet conveying direction of the standby tray and axis of which are perpendicular to the conveying direction; and driven rollers that rotate following the driving rollers and are provided at a leading end portion in the sheet conveying direction of the standby tray such that an interval thereof is narrowed in the sheet conveying direction.

DETAILED DESCRIPTION OF THE INVENTION

Throughout this description, the embodiments and examples shown should be considered as exemplars, rather than limitations on the apparatus and methods of the present invention.

An embodiment of a printing apparatus according to the present invention will be hereinafter explained in detail using the drawings.

Figure 1:
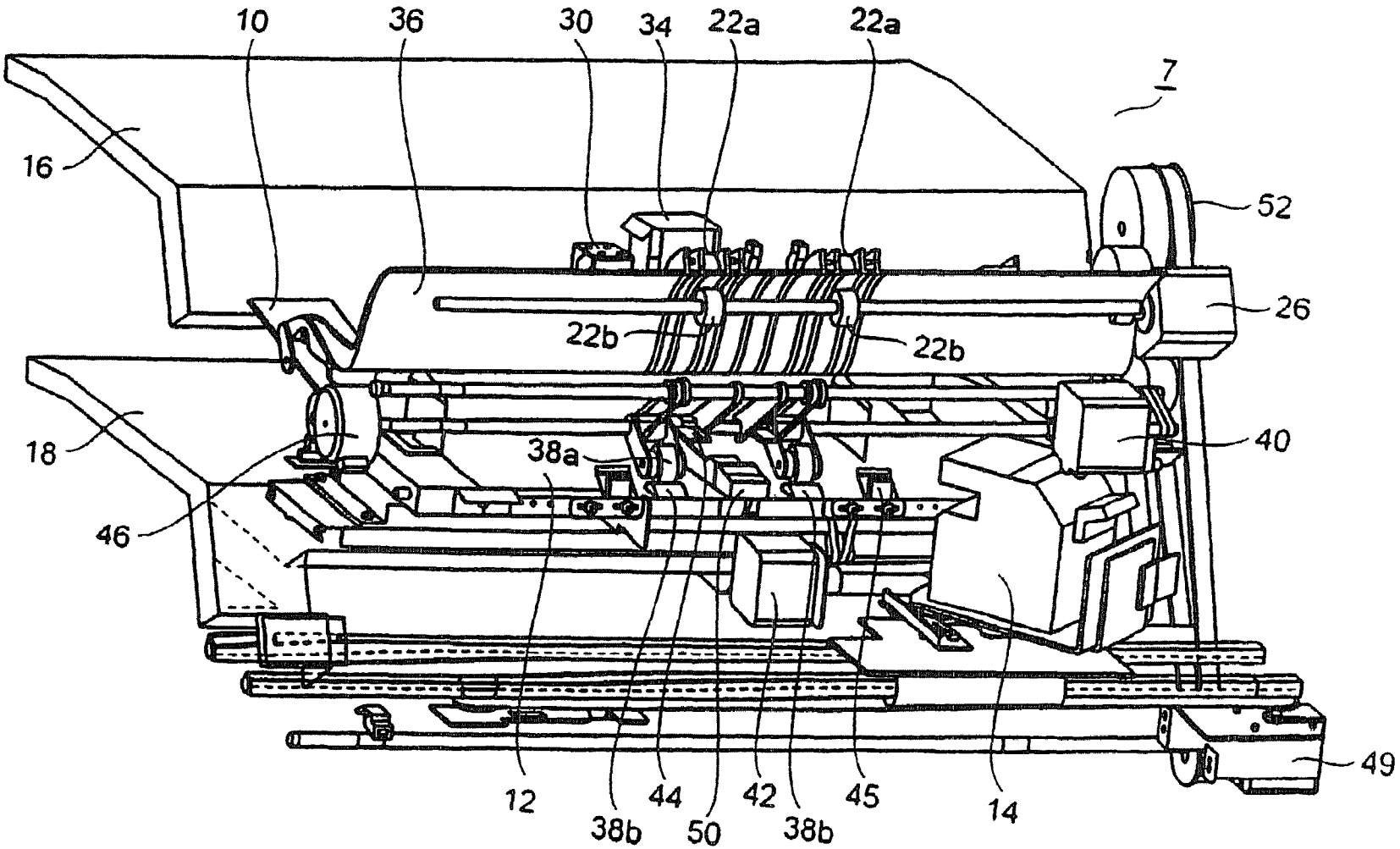
FIG. 1 is a perspective view showing a main part of a sheet post-processing apparatus according to an embodiment of the invention.
Figure 2:
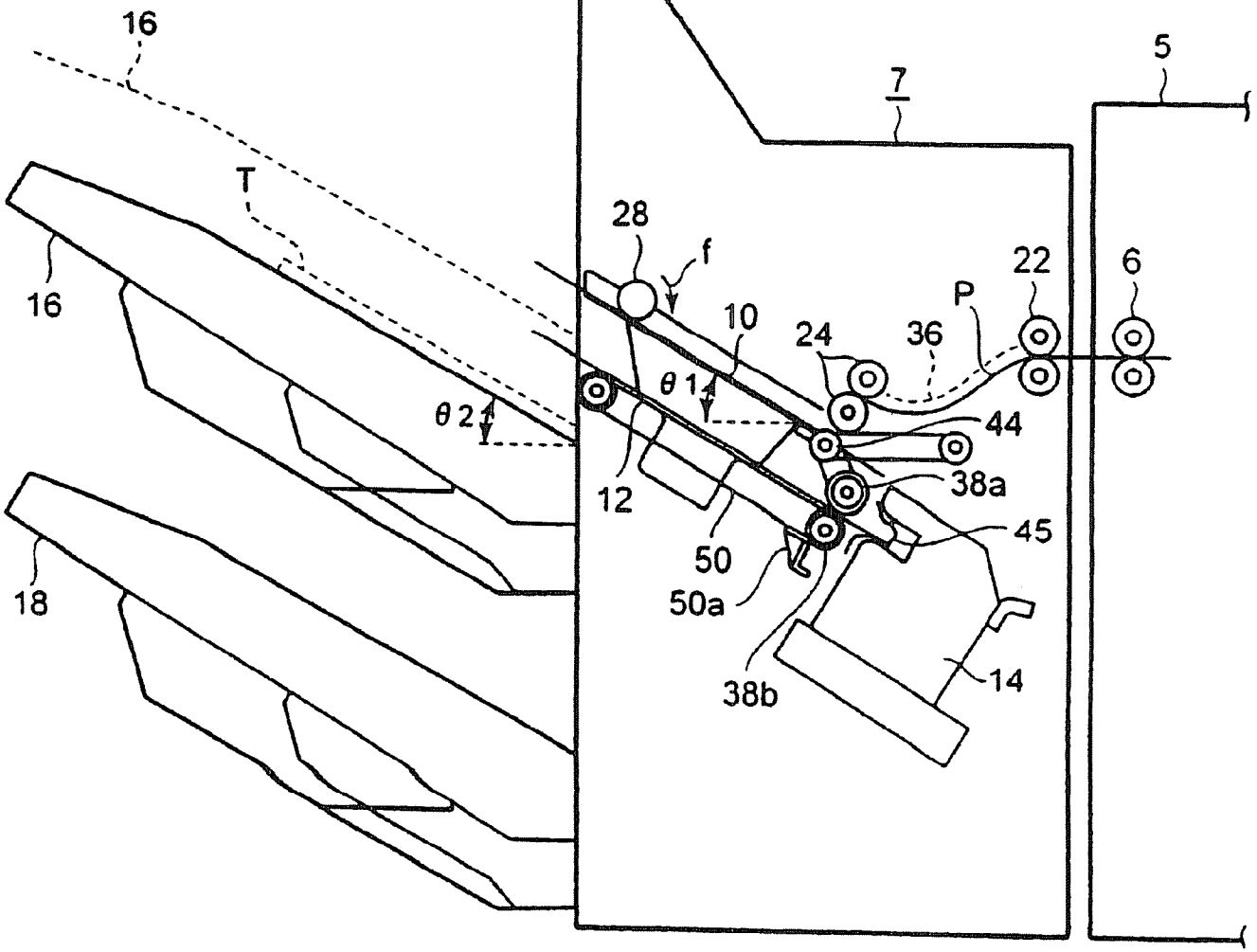
FIG. 2 is a schematic diagram showing the sheet post-processing apparatus according to the embodiment of the invention.

FIG. 1 is a perspective view showing a main part of a sheet post-processing apparatus 7 according to the embodiment of the invention. FIG. 2 is a schematic diagram showing the sheet post-processing apparatus 7 arranged adjacent to an MFP 5 such as a copying machine.

This sheet post-processing apparatus 7 basically includes a standby tray 10, a processing tray 12, a stapler 14, a first paper discharge try 16, and a second paper discharge tray 18.

A sheet P subjected to image formation in the MFP 5 such as a copying machine and discharged from a pair of paper discharge rollers 6 is received by a pair of entrance rollers 22, supplied to a pair of paper feeding rollers 24, and sent from the paper feeding rollers 24 to the standby tray 10. The entrance rollers 22 are driven by an entrance roller motor 26. A paper pass ceiling 36 that guides the paper P to the paper feeding rollers 24 is provided between the entrance rollers 22 to the standby tray 10. The entrance rollers 22 consist of an upper entrance roller 22*a* and a lower entrance roller 22*b*. The paper feeding rollers 24 also consist of an upper paper feeding roller and a lower paper feeding roller. An entrance sensor (not shown) that detects a leading end of the sheet P and an exit sensor (not shown) that detects a trailing end of the sheet P are disposed between the entrance rollers 22 and the paper feeding rollers 24. Actuators are suitable as these sensors.

The processing tray 12 on which sheets P dropped and supplied from the standby tray 10 are stacked is arranged below the standby tray 10. A processing-tray sheet detection sensor (not shown) that detects the sheet P is disposed in the middle in a length direction of the processing tray 12.

The processing tray 12 aligns and supports the sheets P stacked thereon during a period in which the sheets P are subjected to staple processing by the stapler 14 serving as a processing mechanism that performs post processing.

Figure 3:
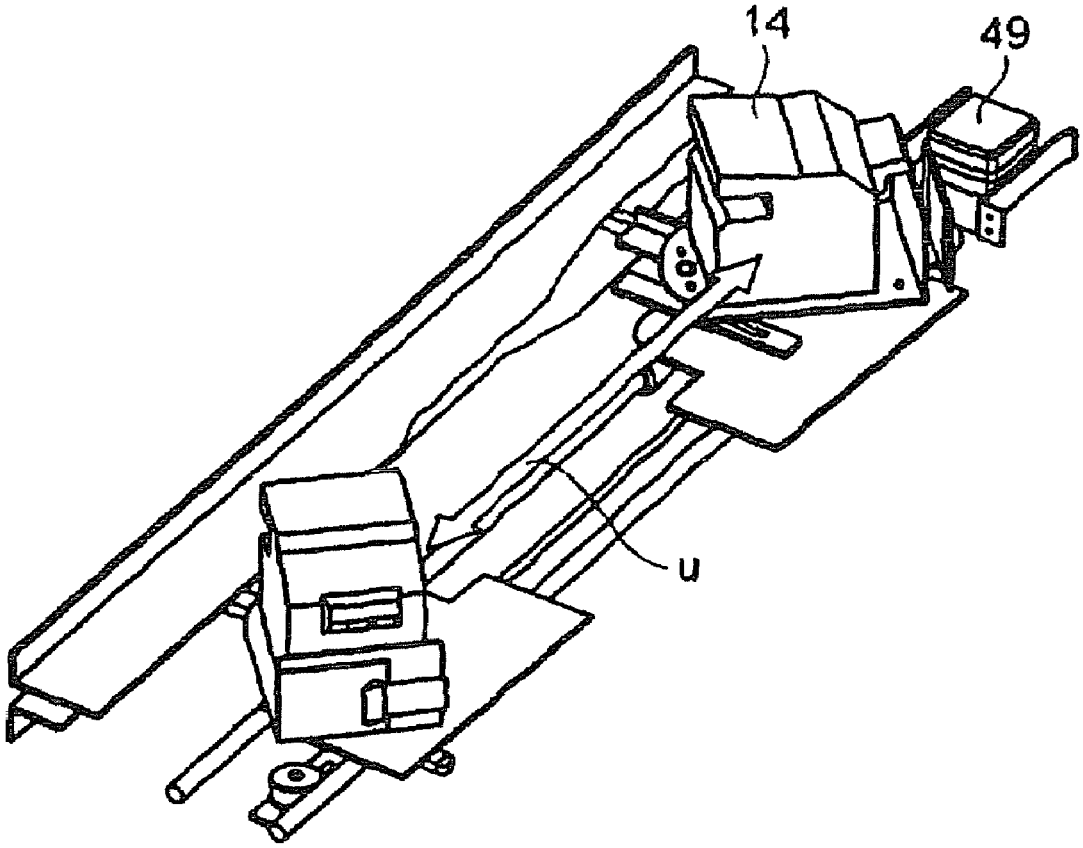
FIG. 3 is a perspective view showing a stapler of the sheet post-processing apparatus according to the embodiment of the invention.
Figure 4:
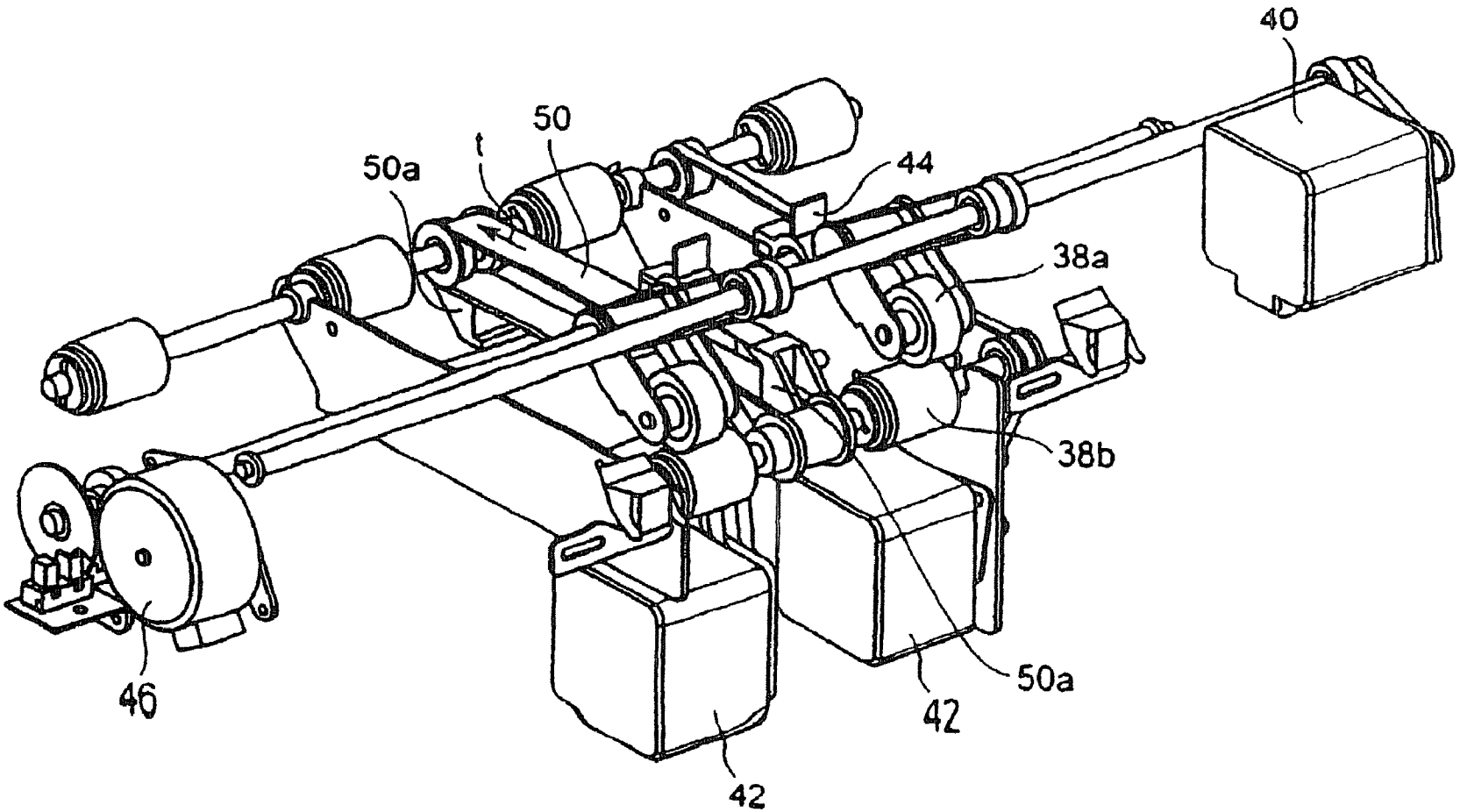
FIG. 4 is a perspective view showing a vertical alignment roller according to the embodiment of the invention.

As shown in FIG. 3, the stapler 14 is positioned by a staple driving unit 49 to have the staple processing controlled. The processing tray 12 has a pair of upper vertical alignment roller 38*a* and lower vertical alignment roller 38*b* shown in FIG. 5 that align the plural sheets P dropped and supplied from the standby tray 10 in a vertical direction, which is the conveying direction. The upper and the lower vertical alignment rollers 38*a* and 38*b* are also used as bundle conveying rollers that nip a sheet bundle T after the finish of the staple processing and take out the sheet bundle T from the stapler 14. The upper vertical alignment roller 38*a* is driven by a vertical alignment upper roller motor 40 and the lower vertical alignment roller 38*b* is driven by a vertical alignment lower roller motor 42.

Figure 5:
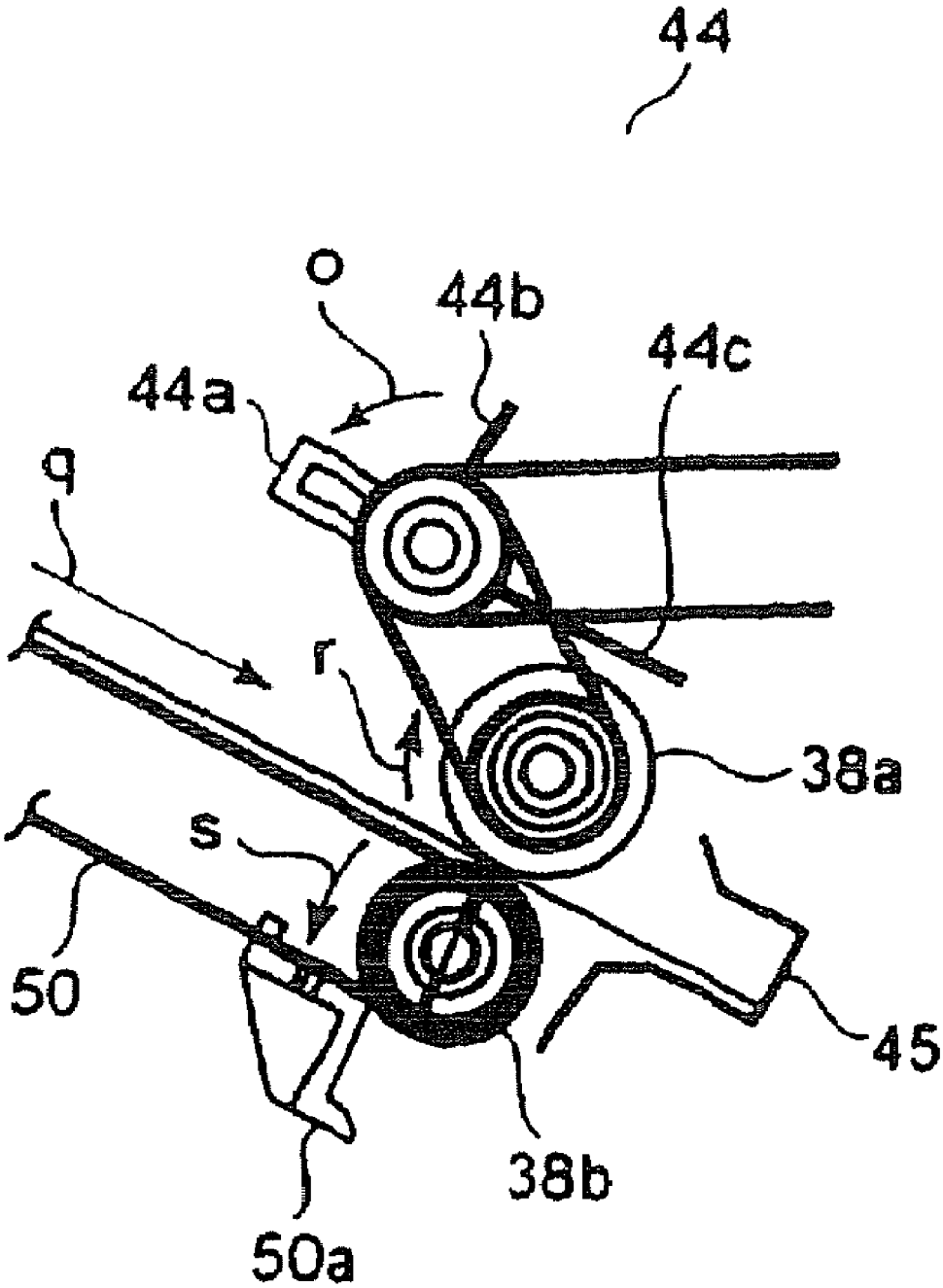
FIG. 5 is an explanatory diagram showing a paddle according to the embodiment of the invention.

In a position to which the trailing end of the sheets P falls when the sheets P are dropped and supplied to the processing tray 12, a rotatable paddle 44 for aligning the sheet P at the top placed on the processing tray 12 in a vertical direction is arranged. The paddle 44 has, as shown in FIG. 5, a receiving section 44*a* for the sheets P dropped and supplied onto the processing tray 12, a tapping section 44*b* that taps down the sheets P onto the processing tray 12, and a feeding section 44*c* that aligns the sheets P on the processing tray 12. The paddle 44 is driven by a paddle motor 46. The paddle 44 is made of a rubber material and has elasticity.

A stopper 45 that comes into contact with the trailing end of the sheets P and regulates a trailing end position is provided at an end on the stapler 14 side of the processing tray 12. A conveyor belt 50 that conveys the sheet bundle T subjected to the staple processing and takes out from the stapler 14 by the upper and the lower vertical alignment rollers 38*a* and 38*b* to the first or the second paper discharge tray 16 or 18 is provided substantially in the center of the processing tray 12. A feeding pawl (a bundle pawl) 50*a* that hooks a trailing end of the sheet bundle T and pushes out the sheet bundle T in a direction of the paper discharge tray 16 or 18 is attached to the conveyor belt 50.

When a sheet is discharged, the feeding pawl (the bundle pawl) 50*a* for discharging a bundle moves from the inner side of the conveyor belt 50 to the paper discharge tray. In the return, the conveyor belt 50 returns below the processing tray 12. A sensor (not shown) for recognizing a home position of the conveyor belt 50 is arranged in the middle of the processing-tray sheet detection sensor and the stapler 14.

As shown in FIG. 2, the standby tray 10 is capable of dropping and supplying the sheets P to the processing tray 12 and, on the other hand, capable of conveying the sheets P in the direction of the first or the second paper discharge tray 16 or 18. The conveyance of the sheets P in the paper discharge tray 16 or 18 direction is performed by bringing a standby tray roller 28, which performs alignment of the sheets P, into contact with the sheets P on the standby tray 10. The standby tray roller 28 is controlled by a standby-tray-roller driving source 30 to move up and down.

The standby tray 10 is arranged to be inclined at an inclination angle θ1 to support the sheets P in a state in which the leading end of the sheets P is higher than the trailing end thereof. The first or the second paper discharge tray 16 or 18 is lifted and lowered by a paper-discharge-tray driving unit 52 and selected. The first or the second paper discharge tray 16 or 18 rises or falls to a substantially same height as the standby tray 10 or the processing tray 12 when the sheets P are stacked thereon and realizes improvement of alignability of the sheets P to be discharged. The first or the second paper discharge tray 16 or 18 is arranged to be inclined at an inclination angle θ2 in order to support the sheets P in a state in which the leading end of the sheets P is higher than the trailing end thereof.

Figure 6:
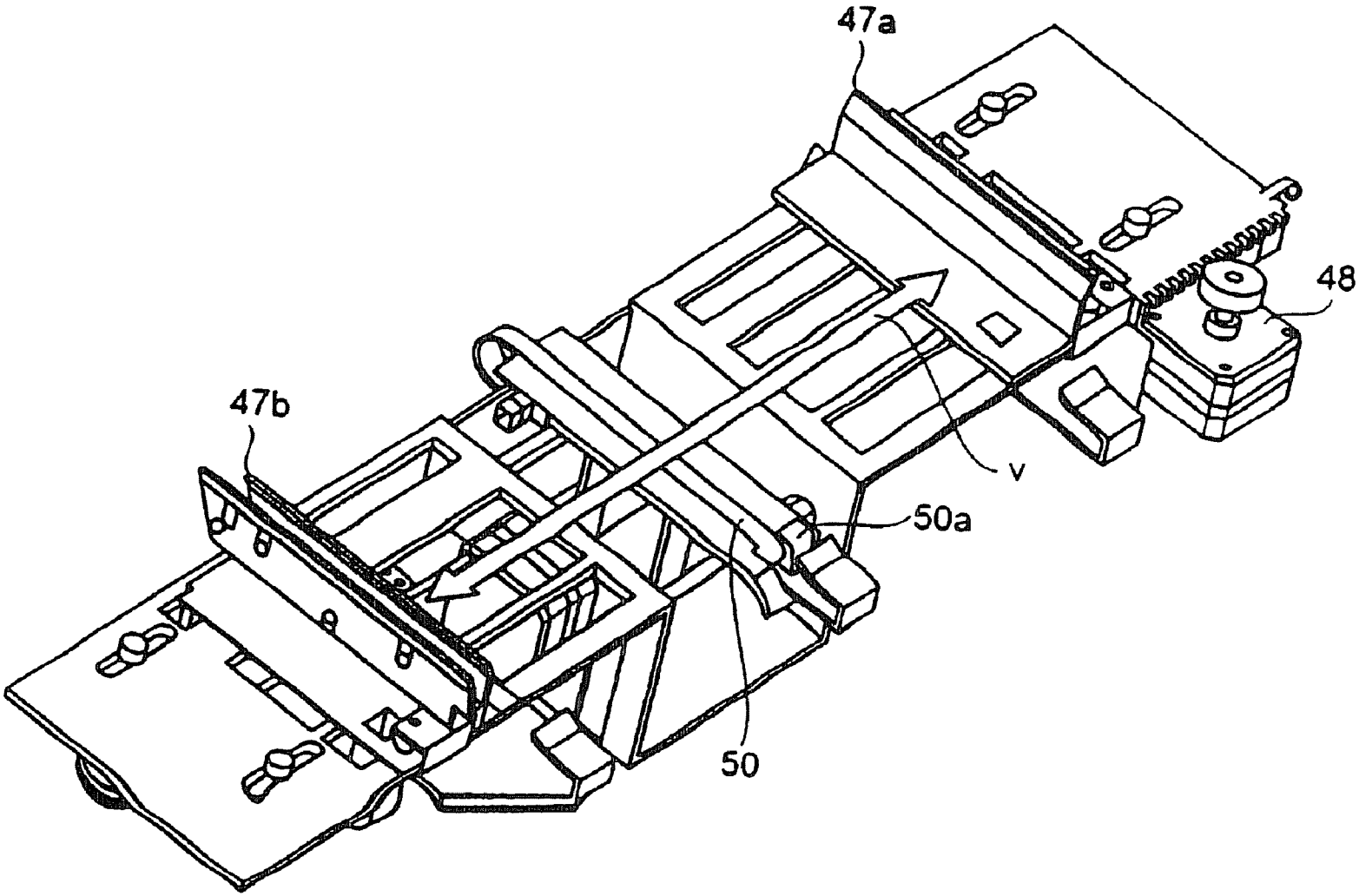
FIG. 6 is a schematic perspective view showing a horizontal aligning plate and a conveyor belt according to the embodiment of the invention.

Between the standby tray 10 and the processing tray 12, horizontal alignment plates 47*a* and 47*b* shown in FIG. 6 that prevent, when the sheets P on the standby tray 10 are dropped and supplied to the processing tray 12, the sheets P from being disarranged in a horizontal direction orthogonal to the conveying direction and perform horizontal alignment are provided. The horizontal alignment plates 47*a* and 47*b* are slidably formed to be adjusted to the width of the sheets P by a horizontal alignment motor 48.

Actions will be described. When the sheets P are subjected to image formation by the MFP 5 and supplied from the paper discharge rollers 6, the sheet post-processing apparatus 7 performs different operation depending on whether the post processing for the sheets P is performed or whether the post processing for the preceding sheets P is being executed or has been finished.

When the post-processing is not performed, for example, the first paper discharge tray 16 slides to a position indicated by a dotted line in FIG. 2 such that the sheets P discharged from the standby tray 10 can be stacked with high alignability. When the post processing is not performed, the sheet P conveyed from the entrance rollers 22 to the paper feeding rollers 24 via the paper pass ceiling 36 is fed to the standby tray 10 by the paper feeding rollers 24. Subsequently, the sheet P is dropped onto the standby tray 10, conveyed by the standby tray roller 28 rotated in an arrow f direction, and discharged to the first paper discharge tray 16.

In this way, sheets are sequentially stacked on the first paper discharge tray 16. The first paper discharge tray 16 is arranged to be inclined at the inclination angle θ2 and a leading end of the sheets is higher than a trailing end thereof. Thus, for example, even if the sheet P is discharged onto the first paper discharge tray 16 in a curled state as indicated by a dotted line in FIG. 2, the sheet P placed on the first paper discharge tray 16 earlier is not pushed out because of contact with the leading end of the following sheet P. In other words, the sheets P discharged are sequentially placed on the first paper discharge tray 16 in a correct order. Even if the preceding sheet P is pushed by the following sheet P and slight positional deviation is caused, since the inclination angle is θ2, the sheets P fall because of own weight thereof and aligned and stacked on the first paper discharge tray 16 in a state in which the sheets P are aligned at the trailing end thereof.

When sheets subjected to image formation by the MFP 5 are received and are not subjected to post processing such as staple or sort, the paper discharge tray 16 or 18 does not perform up and down operations at all until the number of sheets discharged from the sheet post-processing apparatus 7 reaches a predetermined number. It is possible to count the number of sheets discharged using, for example, a sheet-upper-surface detection sensor (not shown) that detects an upper surface of the sheets.

When the number of sheets stacked on the paper discharge tray 16 or 18 has reached the predetermined number, the up and down operations of the paper discharge tray 16 or 18 are performed and remaining of the trailing end of the sheets in a sheet discharge port (not shown) of the sheet post-processing apparatus 7 is prevented to perform accurate upper surface detection.

It is suitable to maintain a stationary state of the paper discharge tray 16 or 18 until the sheet-upper-surface detection sensor continues to be in an ON state for a predetermined time or more, for example, 5 msec or more after the number of sheets has reached the predetermined number. This is because, in general, presence of a dead zone is inevitable in actuators such as various sensors.

The upper surface of the sheets is detected for the purpose of managing the number of sheets not to exceed a stackable number of sheets of the paper discharge tray 16 or 18 and grasping a present movable position of the paper discharge tray 16 or 18.

The number of sheets set described above may be set to, for example, forty as default at the time of shipment of the sheet post-processing apparatus 7 or a user may set the number of sheets. A stroke amount of the up and down operations of the paper discharge tray 16 or 18 is set to at least about 50 mm. When the stroke amount is too small, this is because hook of the trailing end of the sheets cannot be released. On the other hand, when the stroke amount is too large, since time is consumed for the up and down operations of the paper discharge tray 16 or 18, productivity falls.

The stroke amount of the up and down operations of the paper discharge tray 16 or 18 may be set as default at the time of shipment of the sheet post-processing apparatus 7 or the user may set the stroke amount. It is suitable that the up and down operations of the paper discharge tray 16 or 18 is faster when the tray is lowered than when the tray is lifted. This is because the sheets fall to the paper discharge tray 16 or 18 faster.

A case in which the staple processing as the post processing is performed and the sheet P being subjected to the staple processing earlier is not present on the processing tray 12 will be explained. A sheet conveying path of the sheet post-processing apparatus 7 will be hereinafter explained using FIGS. 8 to 10.

The sheet P subjected to image formation by the MFP 5 and discharged from the pair of paper discharge rollers is received by the pair of entrance rollers 22, supplied to the pair of paper feeding rollers 24, and sent from the paper feeding rollers 24 to the standby tray 10.

When the post processing such as the staple processing is thereafter applied to the sheets P sent, the sheets P are sent to the processing tray 12 that executes the post processing. After being subjected to the staple processing by the stapler 14, the sheets P are discharged to the first paper discharge tray 16 or the second paper discharge tray 18.

A job for creating two bundles of five sheets (pages) will be explained as an example. For ease of understanding, sheets of a first bundle are set as A1, A2, . . . , A5 and sheets of a second bundle are set as B1, B2, . . . , and B5 in the explanation.

First, a case in which a bundle of A is created will be explained.

Figure 7:
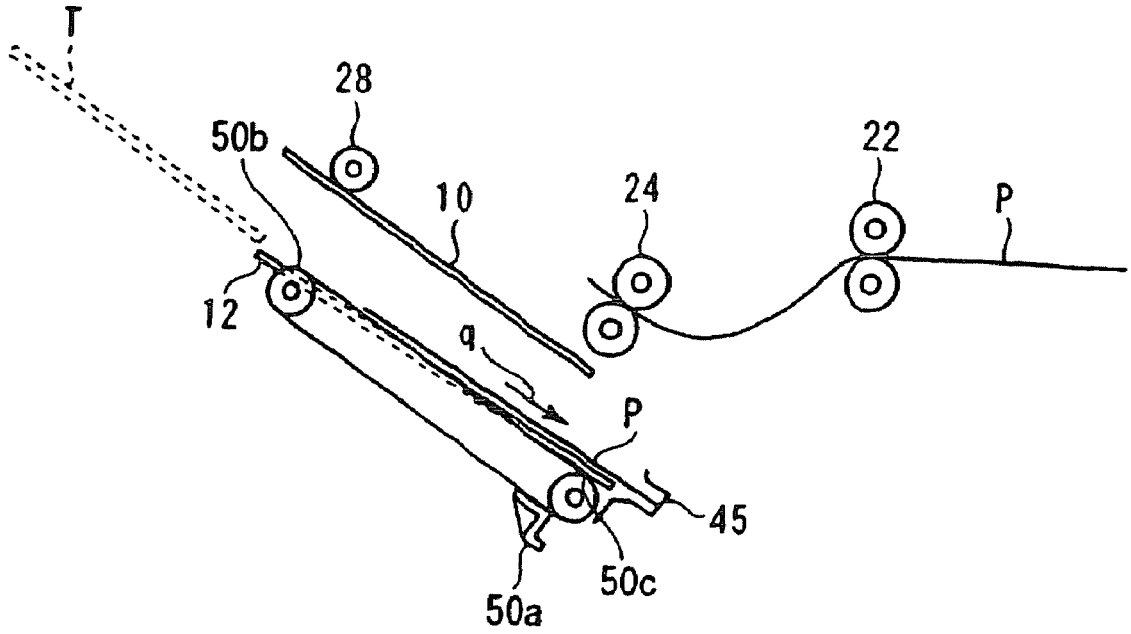
FIG. 7 is an explanatory diagram showing a state in which a sheet on a standby tray or a paper discharge tray is pushed out according to the embodiment of the invention.

As shown in FIG. 7, the horizontal alignment plates 47*a* and 47*b* provided in the processing tray 12 are arranged such that an interval between the horizontal alignment plates 47*a* and 47*b* is substantially the same as the width of the sheets P in order to align the dropped sheets P in the horizontal direction. Consequently, the sheets P fed by the paper feeding rollers 24 are dropped and supplied onto the processing tray 12.

When the bundle of A is created, the sheets P being subjected to the staple processing earlier are not present on the processing tray 12. In this case, any one of the following conveyance forms may be taken: the sheets P may be conveyed onto the processing tray 12 through the standby tray 10 (the sheets P may be placed on the standby tray 10 and, then, dropped to the processing tray 12) or the sheets P may be conveyed to the processing tray 12 without being placed on the standby tray 10 by opening the standby tray 10.

When the sheets P are dropped and supplied, the upper vertical alignment roller 38*a* shown in FIG. 5 is retracted upward and the receiving section 44*a* of the paddle 44 receives the trailing end of the sheets P. The sheets P fall with both sides thereof in contact with the horizontal alignment plates 47*a* and 47*b* and the sheets P are aligned in the horizontal direction. Subsequently, the paddle 44 rotates in an arrow o direction, drops the trailing end of the sheets P from the receiving section 44*a*, and taps down the sheets P onto the processing tray 12 using the tapping section 44*b*. Moreover, the paddle 44 sends the sheets P in an arrow q direction using the feeding section 44*c* and brings the trailing end of the sheets P into contact with the stopper 45 to complete the alignment of the sheets P in the vertical direction. The alignment in the vertical direction of the sheets P on the processing tray 12 may be performed by the upper vertical alignment roller 38*a* by moving the upper vertical alignment roller 38*a* up and down every time the alignment is performed.

In this way, while being sequentially aligned in the horizontal direction and the vertical direction, the sheets P subjected to image formation are stacked on the processing tray 12 from the paper feeding rollers 24 through the standby tray 10 or without being placed on the opened standby tray 10. When the sheets A1, A2, . . . , A5 of the first bundle are stacked on the processing tray 12, the stapler 14 staples the sheets P on the processing tray 12 in desired positions into a bundle shape and forms a sheet bundle. Thereafter, the upper vertical alignment roller 38*a* is lowered onto the sheet bundle and the sheet bundle is nipped by the upper vertical alignment roller 38*a* rotating in an arrow r direction and the lower vertical alignment roller 38*b* rotating in an arrow s direction and conveyed in the direction of the first paper discharge tray 16.

When a trailing end of the sheet bundle passes the upper and the lower vertical alignment rollers 38*a* and 38*b*, the trailing end is hooked by the feeding pawl 50*a* of the conveyor belt 50 rotated in an arrow t direction and the sheet bundle is sent out onto the first paper discharge tray 16. At this point, the first paper discharge tray 16 is slid from the position indicated by the dotted line to a position indicated by a solid line in FIG. 2.

A case in which the bundle of B is created will be explained.

When the bundle of B is created, the sheets A are present or not present on the processing tray 12 depending on processing speed of the MFP 5 or processing speed of the stapler 14.

Time calculated by adding up a conveyance time of the sheet A1 and time between the sheets A1 and A2, i.e., a so-called inter-paper time is set as T1, a staple processing time is set as T2, and time for discharging a bundle of sheets after staple to the paper discharge tray is set as T3.

After the sheet A5, the sheet B1 is conveyed. In this case, if the sheet bundle of A is not discharged from the processing tray 12 to the paper discharge tray before the sheet B1 reaches the processing tray 12, a problem occurs. It is assumed that the sheet B1 falls onto the processing tray 12 while the sheet bundle of A is conveyed to the paper discharge tray. In this case, the problem occurs because the sheet B1 is stacked on the sheet bundle of A and directly discharged together with the sheet bundle of A.

Therefore, the problem occurs unless the staple processing time T2 and the time T3 for discharging the bundle of sheets after staple to the paper discharge tray end within the time T1.

When the processing speed of the MFP 5 is low and the time T1 is longer than the time calculated by adding up the staple processing time T2 and the time T3 for discharging the bundle of sheets after staple to the paper discharge tray, i.e., T1>(T2+T3), the problem described above does not occur. In the case of a combination of the MFP 5 and the sheet post-processing apparatus 7 that satisfies such processing times T1, T2, and T3, when the bundle of B is created, the sheets A are not present on the processing tray 12.

Figure 8:
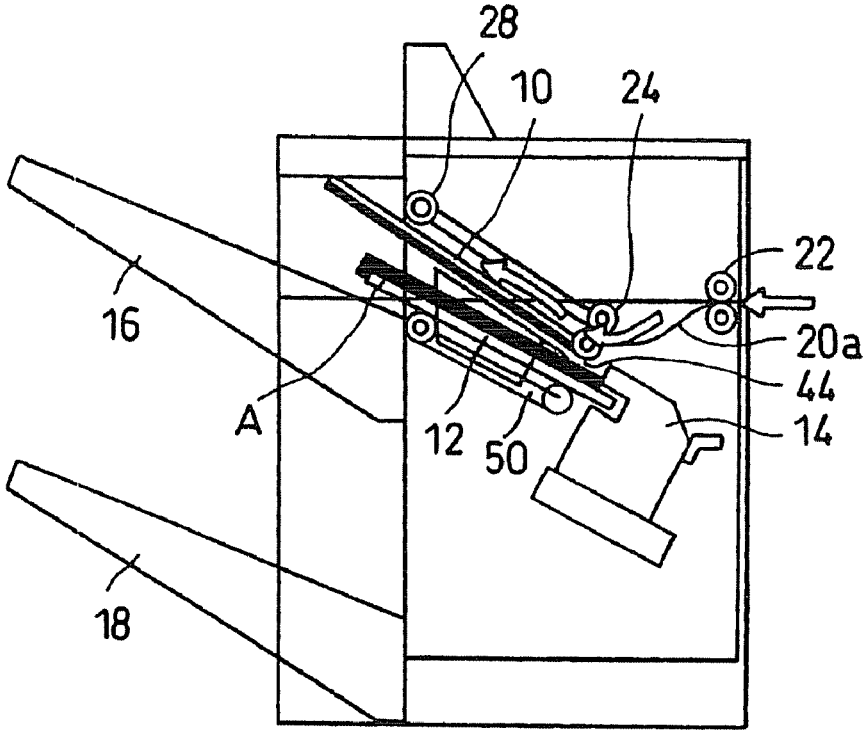
FIG. 8 is an explanatory diagram for explaining timing of buffering.
Figure 9:
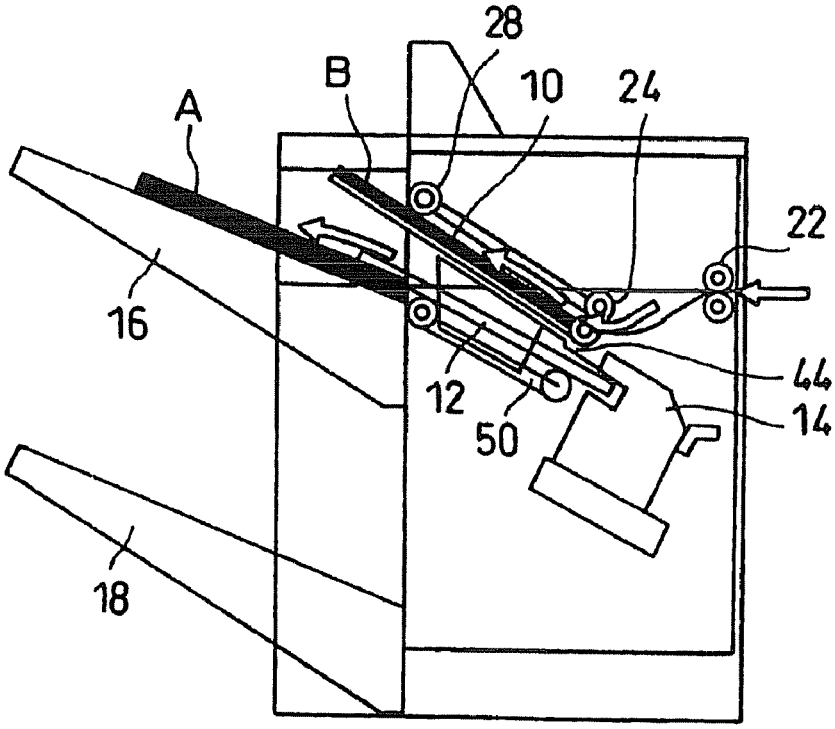
FIG. 9 is an explanatory diagram for explaining timing of buffering.

In recent years, processing speed of an MFP is extremely high and a sheet interval is extremely short. Therefore, since the time T1 is extremely short, T1>(T2+T3) may not be satisfied. When the sheet B1 is conveyed to the position of the standby tray 10, the sheet bundle of A is present on the processing tray 12 (FIG. 8). In this case, it is necessary to prevent the sheet B1 from falling to the processing tray 12 until the sheet bundle A is discharged to the paper discharge tray. However, if conveyance of the following sheets including the sheet B1 is delayed, the original processing speed of the MFP 5 cannot be satisfied.

Figure 10:
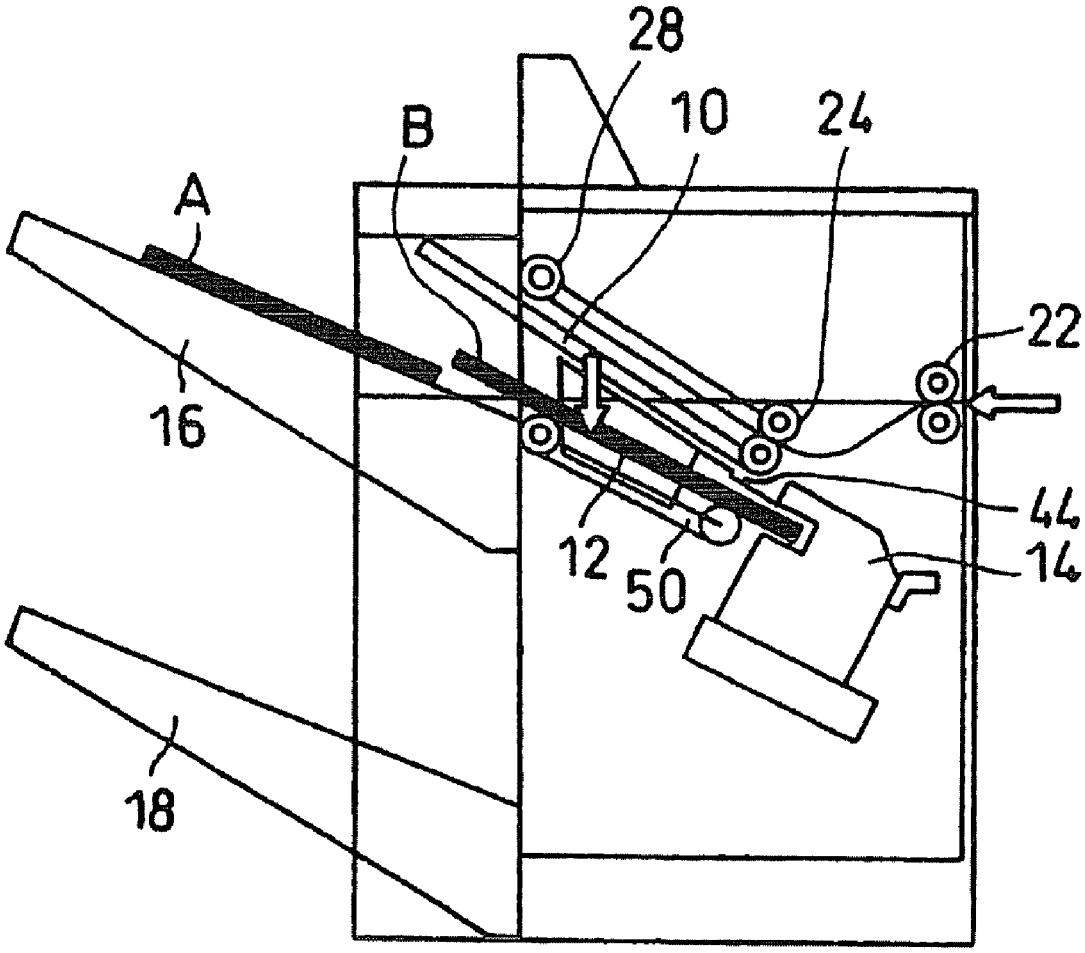
FIG. 10 is an explanatory diagram for explaining timing of buffering.

Thus, the following sheets are held on the standby tray 10 until the bundle of the sheets A is discharged to the paper discharge tray (FIG. 9) and, after it is confirmed that the bundle of the sheets A is discharged to the paper discharge tray, the sheets are dropped from the standby tray 10 to the processing tray 12 (FIG. 10). At this point, the horizontal alignment plates 47*a* and 47*b* are arranged such that the interval between the alignment plates is substantially the same as the width of the sheets P. Therefore, the sheets P dropped from the standby tray 10 are regulated by the horizontal alignment plates 47*a* and 47*b* on both the sides and aligned in the horizontal direction.

The sheet P on the lower side of the two sheets P dropped to the processing tray 12 is sent in the arrow q direction by the lower vertical alignment roller 38*b* rotated in a direction opposite to the arrow s direction and the trailing end of the sheet P is brought into contact with the stopper 45 to complete the alignment in the vertical direction of the sheet P. The sheet P on the upper side of the two sheets P dropped to the processing tray 12 is sent in the arrow q direction by the upper vertical alignment roller 38*a* rotated in a direction opposite to the arrow r direction and the trailing end of the sheet P is brought into contact with the stopper 45 to complete the alignment in the vertical direction of the sheet P. Thereafter, the upper vertical alignment roller 38*a* is retracted upward.

When the sheets B1, B2, . . . , and B5 of the second bundle are stacked on the processing tray 12, the stapler 14 staples the sheets on the processing tray 12 in desired positions into a bundle shape and forms a sheet bundle. Thereafter, the upper vertical alignment roller 38*a* is lowered onto the sheet bundle and the sheet bundle is nipped by the upper vertical alignment roller 38*a* rotating in the arrow r direction and the lower vertical alignment roller 38*b* rotating in the arrow s direction and conveyed in the direction of the first paper discharge tray 16 to complete the staple processing.

Figure 11:
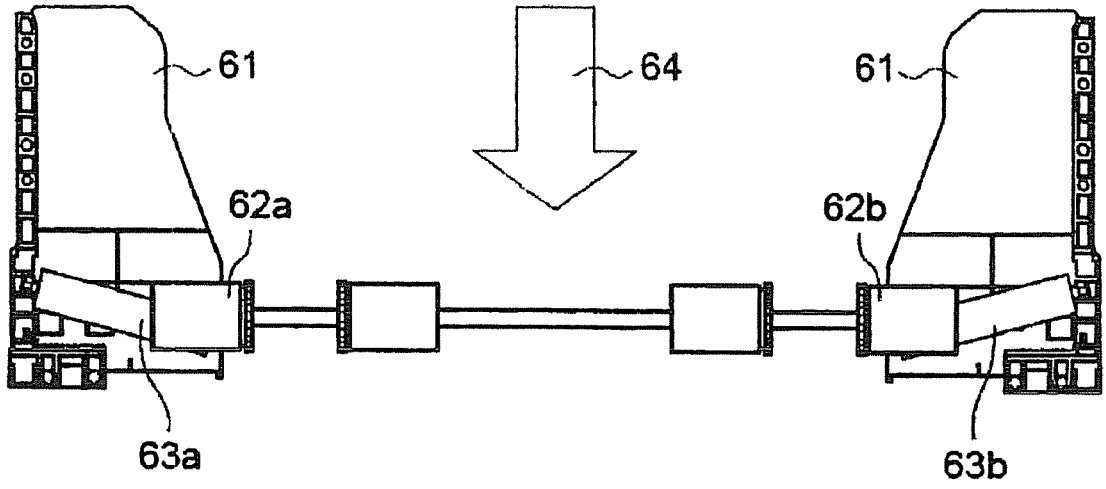
FIG. 11 is an explanatory diagram showing a positional relation between driven rollers and the standby tray according to the embodiment of the invention.
Figure 12:
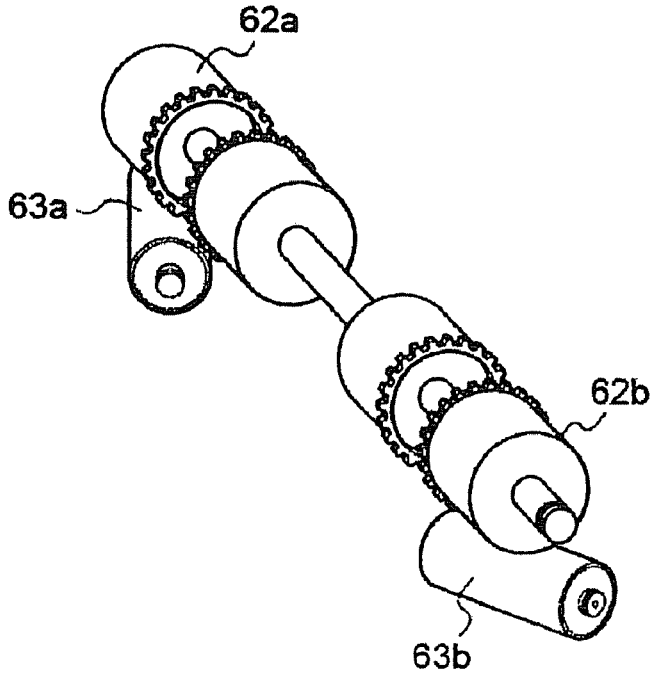
FIG. 12 is an explanatory diagram showing a positional relation between driving rollers and the driven rollers according to the embodiment of the invention.

FIG. 11 is a diagram of a movable sheet receiving plate 61 of the standby tray 10, driving rollers 62*a* and 62*b*, and driven rollers 63*a* and 63*b* viewed from above. FIG. 12 is a perspective view of the driving rollers 62*a* and 62*b* and the driven rollers 63*a* and 63*b*. The driving rollers 62*a* and 62*b* are arranged above a leading end position in the sheet conveying direction of the movable sheet receiving plate 61 of the standby tray 10. The driven rollers 63*a* and 63*b* are rotatably attached to a leading end portion in the sheet conveying direction of the movable sheet receiving plate 61. Axis of the driving rollers 62*a* and 62*b* are perpendicular to the sheet conveying direction and driven by a not-shown driving motor. A sheet having an image formed thereon is conveyed on the movable sheet receiving plate 61 in a direction of an arrow 64. The driven roller 63*a* and the driven roller 63*b* are arranged such that an interval between the driven rollers is narrowed in the sheet conveying direction.

The driving roller 62*a* forms a pair with the driven roller 63*a* and the driving roller 62*b* forms a pair with the driven roller 63*b*. The driven rollers 63*a* and 63*b* rotate following the driving rollers 62*a* and 62*b* and reversely to the rotation of the driving rollers 62*a* and 62*b*.

As shown in FIGS. 11 and 12, axis of both the driven rollers 63*a* and 63*b* are arranged with opposed shaft end sides thereof projected in the sheet conveying direction. Therefore, the axis of the driving rollers 62*a* and 62*b* and the axis of the driven rollers 63*a* and 63*b* are not parallel and form a predetermined angle. In other words, the driven rollers 63*a* and 63*b* are provided on the left and the right with respect to the sheet conveying direction. An intersection of the axis of the driven rollers 63*a* and 63*b* is located further on a downstream side in the sheet conveying direction than the axis of the driving rollers.

A smaller angle of angles formed by the rotating shaft of the driven roller 63*a* and the rotating shaft of the driving roller 62*a* and a smaller angle of angles formed by the rotating shaft of the driven roller 63*b* and the rotating shaft of the driving roller 62*b* are desirably equal to or larger than 2° and equal to or smaller than 3°, respectively, and these angles are desirably the same.

A sheet is guided to an outer side with respect to the sheet conveying direction through a space between the driving roller 62*a* and the driven roller 63*a* and a space between the driving roller 62*b* and the driven roller 63*b*.

The driving rollers 62*a* and 62*b* are formed of rubber, more desirably, EPDM (random copolymer rubber of ethylene, propylene, and disconjugated diene). The driven rollers 63*a* and 63*b* are formed of resin, more desirably, polyacetal.

As described above, the driving rollers 62*a* and 62*b* and the driven rollers 63*a* and 63*b* are arranged in the leading end portion in the sheet conveying direction of the movable sheet receiving plate 61 of the standby tray 10. Thus, a sheet conveyed is stretched in the conveying direction and the direction perpendicular to the conveying direction and it is possible to prevent the sheet from being bent in a V shape. As a result, since the sheet conveyed falls onto the processing tray 12 with a leading end portion thereof hanging down, alignment in the vertical direction is surely performed.

In another embodiment, instead of attaching the driven rollers 63*a* and 63*b* to the movable sheet receiving plate 61, the driving rollers 62*a* and 62*b* and the driven rollers 63*a* and 63*b* can be arranged in the leading end portion in the sheet conveying direction of the movable sheet receiving plate 61 while being spaced apart from the movable sheet receiving plate 61.

The movable sheet receiving plate 61 opens in the direction perpendicular to the sheet conveying direction and drops a sheet to the processing tray 12. When the movable sheet receiving plate 61 opens, the driven rollers 63*a* and 63*b* also open in the direction perpendicular to the sheet conveying direction.

With such a constitution, effects same as those in the embodiment described above are obtained.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet post-processing apparatus comprising:

a standby tray that subjects a sheet discharged from an image forming apparatus to buffering while the sheet is sent to a conveying path at a next stage;

a processing tray that is arranged below the standby tray and on which the sheet dropped and supplied from the standby tray and/or the sheet discharged from the image forming apparatus without passing through the standby tray is stacked;

driving rollers that are arranged in a leading end position in a sheet conveying direction of the standby tray and rotating shafts of which are perpendicular to the sheet conveying direction; and driven rollers that rotate following the driving rollers and are provided on left and right with respect to the sheet conveying direction, rotating shafts of which are not parallel to the rotating shafts of the driving rollers and an intersection of the rotating shafts of which is located further on a downstream side in the sheet conveying direction than the rotating shafts of the driving rollers, the driven rollers being attached to a front portion in the sheet conveying direction of the standby tray, the driven rollers being attached to both end portions in horizontal direction of the sheet in the sheet conveying direction of the standby tray.

2. A sheet post-processing apparatus according to claim 1, wherein the driven rollers being separately attached to only both end portions of horizontal direction in the sheet conveying direction of the standby tray.

3. A sheet post-processing apparatus according to claim 1, wherein smaller angles of angles formed by the axis of the driving rollers forming pairs with the axis of the left and the right driven rollers, respectively, are arranged to be a same angle.

4. A sheet post-processing apparatus according to claim 1, wherein the driven rollers are longer than the driving rollers, and cross the driving rollers at the inner part of the sheet conveying.

5. A sheet post-processing apparatus according to claim 1, wherein the driven rollers are longer than the driving rollers, and cross the driving rollers at the inner part in horizontal direction of the sheet in the sheet conveying direction.

6. A sheet post-processing apparatus comprising:

a standby tray that subjects a sheet discharged from an image forming apparatus to buffering while the sheet is sent to a conveying path at a next stage;

a processing tray that is arranged below the standby tray and on which the sheet dropped and supplied from the standby tray and/or the sheet discharged from the image forming apparatus without passing through the standby tray is stacked;

driving rollers that are arranged in a leading end position in a sheet conveying direction of the standby tray and rotating shafts of which are perpendicular to the sheet conveying direction; and driven rollers that rotate following the driving rollers and are provided on left and right with respect to the sheet conveying direction, rotating shafts of which are not parallel to the rotating shafts of the driving rollers and an intersection of the rotating shafts of which is located further on a downstream side in the sheet conveying direction than the rotating shafts of the driving rollers, the driven rollers being attached to a front portion in the sheet conveying direction of the standby tray, smaller angles of angles formed by the rotating shafts of the driving rollers and the rotating shafts of the driven rollers of each left and right pair of driving roller and driven roller, respectively, are arranged to be a same angle.

7. A sheet post-processing apparatus according to claim 6, wherein, when the movable sheet receiving plate opens perpendicularly to the sheet conveying direction, the driven rollers open in a direction perpendicular to the sheet conveying direction of the standby tray.

8. A sheet post-processing apparatus according to claim 6, wherein the driving rollers are formed of rubber and the driven rollers are formed of resin.

9. A sheet post-processing apparatus according to claim 6, wherein the driven rollers being spaced apart from the standby tray.

10. A sheet post-processing apparatus according to claim 6, wherein a smaller angle of angles formed by the rotating shafts of the driven rollers and the rotating shafts of the driving rollers is arranged to be equal to or larger than 2° and equal to or: smaller than 3°.

* * * * *